US012760731B2

(12) United States Patent
Mandallaz et al.

(10) Patent No.: US 12,760,731 B2
(45) Date of Patent: Oct. 13, 2026

(54) VACUUM PUMP

(71) Applicant: PFEIFFER VACUUM, Annecy (FR)

(72) Inventors: Éric Mandallaz, Annecy Cedex (FR); Patrick Philippe, Annecy Cedex (FR)

(73) Assignee: PFEIFFER VACUUM, Annecy (FR)

( * ) Notice: Subject to any disclaimer, the term of this patent is extended or adjusted under 35 U.S.C. 154(b) by 142 days.

(21) Appl. No.: 18/871,357

(22) PCT Filed: Apr. 7, 2023

(86) PCT No.: PCT/EP2023/059327

§ 371 (c)(1),
(2) Date: Dec. 3, 2024

(87) PCT Pub. No.: WO2023/247083

PCT Pub. Date: Dec. 28, 2023

(65) Prior Publication Data

US 2026/0243257 A1 Aug. 20, 2026

(30) Foreign Application Priority Data

Jun. 22, 2022 (FR) ..... 2206188

(51) Int. Cl.
*F04C 25/02* (2006.01)
*F04C 18/12* (2006.01)
(Continued)

(52) U.S. Cl.
CPC ..... *F04C 25/02* (2013.01); *F04C 18/12* (2013.01); *F04C 29/0092* (2013.01);
(Continued)

(58) Field of Classification Search
CPC ..... F04C 25/02; F04C 18/12; F04C 18/126; F04C 29/0007; F04C 29/0092;
(Continued)

(56) References Cited

U.S. PATENT DOCUMENTS 7,108,492 B2 * 9/2006 Yamamoto ..... F04C 18/126 418/5
8,529,231 B2 * 9/2013 Park ..... F04C 18/126 418/5

FOREIGN PATENT DOCUMENTS

EP 1 990 543 A1 11/2008
EP 3 628 870 A1 4/2020
(Continued)

OTHER PUBLICATIONS

International Search Report & Written Opinion issued Aug. 1, 2023 in PCT/EP2023/059327, filed on Apr. 7, 2023, 11 pages (with English Translation).

*Primary Examiner* — Loren C Edwards
(74) *Attorney, Agent, or Firm* — Oblon, McClelland, Maier & Neustadt, L.L.P.

(57) ABSTRACT

A dry vacuum pump includes at least one purge duct having two channels which are provided in the thickness of an interstage transverse half-wall of a half-shell. Each channel opens from a front face of the interstage transverse half-wall via a respective opening into the interior space of a pumping stage. A transverse groove is provided in the interstage transverse half-wall at a joining surface of the half-shells. The channels are made up of tubular ducts which are formed between an inclined plane of the transverse groove and the front face.

13 Claims, 5 Drawing Sheets

(51) Int. Cl.
*F04C 29/00* (2006.01)
*F04C 29/12* (2006.01)

(52) U.S. Cl.
CPC ..... *F04C 29/12* (2013.01); *F04C 2220/12* (2013.01); *F04C 2240/30* (2013.01)

(58) Field of Classification Search
CPC .... F04C 29/042; F04C 29/12; F04C 2220/12; F04C 2240/30; F01C 21/10
See application file for complete search history.

(56) References Cited

FOREIGN PATENT DOCUMENTS

| | | | | | |
|---|---|---|---|---|---|
| GB | 2621854 | A | * | 2/2024 | ..... F04C 29/0092 |
| WO | WO 2021/219307 | A1 | | 11/2021 | |

* cited by examiner

VACUUM PUMP

TECHNICAL FIELD OF THE INVENTION

The present invention relates to a vacuum pump and more particularly to a purge duct of said vacuum pump.

TECHNICAL BACKGROUND

Dry vacuum pumps have one or more pumping stages in series, in which a gas being pumped circulates between a suction port and a delivery port. Among known vacuum pumps, a distinction is made between those with rotary lobes, also known as "Roots" pumps, or those with claws, also known as "claw" pumps. These vacuum pumps are referred to as "dry" since, in operation, the rotors rotate inside the stator without any mechanical contact with each other or with the stator, thereby obviating the need to use oil in the pumping stages.

Certain vacuum pumps are used in processes for manufacturing semiconductors, flat screens, photovoltaic panels or coatings, notably processes for depositing thin films under vacuum known as high-aspect-ratio processes (HARP), notably CVD, PECVD, SACVD, ALD, etc. These processes generally alternate deposition steps in which process gases, such as resin vapors or precursors, are introduced into the reactor for thin film deposition, with cleaning steps in which active gases, such as corrosive gaseous species, are introduced into the reactor to clean the walls of the reactor.

The gases used for the deposition steps can generate by-products in large quantities in solid form (powders, pastes, pieces). A large accumulation of powders on the moving parts of the vacuum pump can quickly lead to the pump stopping as a result of mechanical seizure. Reducing the failure rate on these powder-generating processes is therefore essential.

To prevent polymerized by-products from polluting the pumping devices, it is known to use traps in the vacuum lines. These traps separate the solid by-products from the gases, for example by gravity or centrifugal force or by condensation or thermolysis, and retain the solid by-products by accumulation. One problem is that the accumulation of powders in the trap increases the probability of encountering species of different chemical nature. This can cause and promote undesirable chemical reactions, such as the polymerization reactions mentioned above. Also, the high temperatures of these traps, generally between 140° C. and 170° C., provide the activation energy promoting these chemical reactions. These traps must therefore be cleaned very regularly.

Another solution consists of adapting, by design, the geometry of the vacuum pump to facilitate the evacuation of the powders, for example by providing transfer channels between wider pumping stages or a vertical vacuum pump.

It is also known to inject a purge fluid such as nitrogen into the vacuum pump to dilute the pumped gases and to promote the evacuation of the powders. This injection is generally carried out at several points distributed along the pumping stages through injection nozzles discharging into the transfer channels or at the delivery ports of the pumping stages.

These injections may nevertheless prove to be insufficient in cases where the manufacturing processes, such as those mentioned above, are highly polluting and the by-products formed are particularly adherent. Accumulations of by-products may persist in meshing zones between the rotors where the clearances are very small.

Indeed, it has been noted that the powders are drawn and accumulate in the zones where these clearances narrow, and the compression in these zones further compacts these powders, making them even harder and adherent.

Document EP1990543A1 proposes a device for injecting purge fluid allowing more efficient purging of the rotors. For this purpose, a purge duct is provided in the thickness of the stator slice and discharges into a pumping stage. Thus provided in the stator body, the purge fluid can be brought to the temperature of the pump body before being injected into the stage. Guide grooves may be provided for the purge fluid in the front face of the stator slice to precisely and efficiently clean between the rotors. The localized injection of the purge fluid allows the injection to be targeted in these zones, which ensures both the dilution of the contaminants and the dispersion by mechanical action of the solid and gaseous by-products likely to be deposited on the rotors.

However, although this solution is well suited for vacuum pumps having a slice architecture, i.e. in which the stators are constituted by joining several stator slices together axially, this solution is difficult to implement in the inter-stage walls in vacuum pump stators having a half-shell architecture. Indeed, half-shell stators can have very thin inter-stage walls, thinner than those of slice-structure stators, making it difficult to machine the purge ducts.

SUMMARY OF THE INVENTION

One aim of the present invention is to propose a vacuum pump that solves at least one of the drawbacks described above.

To this end, the invention relates to a dry vacuum pump including:

- a stator including at least a first half-shell and a second half-shell which are complementary and joined together to form at least two pump stages arranged in series and axially separated from each other by a respective inter-stage transverse wall of the half-shells,
- two shafts of the rotors extending in the axial direction, designed to rotate in the pumping stages, characterized in that it includes at least one purge line including:

- two channels provided in the thickness of an inter-stage transverse half-wall of a half-shell, each channel discharging from a front face of the inter-stage transverse half-wall via a respective orifice into the space inside a pumping stage, and
- a transverse groove provided in the inter-stage transverse half-wall at a joining surface of the half-shells, the channels being formed by tubular ducts formed between an inclined plane of the transverse groove and the front face.

The purge lines discharging into the pumping stages from the front face facing the rotors thus clean the profiles of the rotors by means of an injection sequenced by the rotation of the rotors, notably in the critical zones between the rotors. The injection may in fact be localized at the meshing zone between the profiles of the rotors where the volume is reduced.

The transverse groove provided in the inter-stage transverse half-wall provides access for a tool for forming the channels by drilling. The oblique drilling of the inter-stage transverse half-wall is possible because the transverse groove has an inclined plane, which allows the formation of orifices discharging from the front face, below the joining surface, despite the thinness of the inter-stage transverse walls.

The vacuum pump can also have one or more of the features described below, taken individually or in combination.

The transverse groove for example has a V-shaped longitudinal section.

The surface of the inter-stage transverse half-wall of the other half-shell at the joining surface may be flat.

The purge duct for example includes a common duct provided in the inter-stage transverse half-wall discharging at the center of the transverse groove.

The orifices may be provided on a circle defined by the sweep of the radial end of a respective rotor.

The orifices may be provided at a distance of between 5 mm and 15 mm from the joining surface in the direction perpendicular to the longitudinal and transverse directions.

The length of the channels is for example between 6 mm and 14 mm, such as 10 mm.

The diameter of the tubular channels is for example between 1 mm and 3 mm, such as 2 mm.

The channels for example discharge from the front face of the inter-stage transverse half-wall of the half-shell bearing the outlets of the pumping stages.

The vacuum pump may have more than two pumping stages. In this case, the half-shells may have several inter-stage transverse half-walls. A purge duct may be provided in each inter-stage transverse half-wall.

The joining surface passes for example through the rotation axes of the shafts of the rotors.

BRIEF DESCRIPTION OF THE FIGURES

Further advantages and features will become apparent on reading the following description of a particular, but non-limiting, embodiment of the invention and from the appended drawings, in which.

In these figures, identical elements are indicated using the same reference numbers.

DETAILED DESCRIPTION

The following embodiments are examples. Although the description refers to one or more embodiments, this does not necessarily mean that each reference relates to the same embodiment, or that the features only apply to a single embodiment. Individual features of different embodiments can also be combined or interchanged to provide other embodiments.

A rough-vacuum pump is a positive displacement vacuum pump that is designed to suction, transfer and then deliver a gas being pumped at or above atmospheric pressure. The rotors of the rough-vacuum pump can be Roots rotors or claw rotors. The rotors are carried on two shafts driven in rotation by a motor of the rough-vacuum pump. A rough-vacuum pump is also designed such that it can be started at atmospheric pressure.

A Roots vacuum pump (also known as a blower, Roots compressor, or booster) is a positive-displacement vacuum pump that is designed to use two Roots rotors to suction, transfer then deliver the gas being pumped. The Roots vacuum pump is arranged upstream of and in series with a rough-vacuum pump. The rotors are carried by two shafts driven in rotation by a motor of the Roots vacuum pump.

An "upstream" element is an element positioned before another element in relation to the direction of flow of the pumped gases. By contrast, a "downstream" element is an element positioned after another element in relation to the direction of flow of the pumped gases. The arrows F in FIG. 1 show the direction of flow of the pumped gases.

The axial direction L is the longitudinal direction of the vacuum pump, in which direction the rotor shafts extend. The transverse direction T is the direction perpendicular to the axial direction L. The transverse plane (T, V) is the plane perpendicular to the longitudinal plane (L, T).

The invention applies to any type of dry vacuum pump, i.e. including two or more pumping stages, such as one comprising between two and ten pumping stages. This vacuum pump may be a rough-vacuum pump including a plurality of pumping stages and designed to deliver the pumped gases at atmospheric pressure or a Roots vacuum pump or compressor with two or three pumping stages which, in use, is connected in series with and upstream of a rough-vacuum pump and the delivery pressure of which is the delivery pressure obtained by the rough-vacuum pump.

Figure 1:
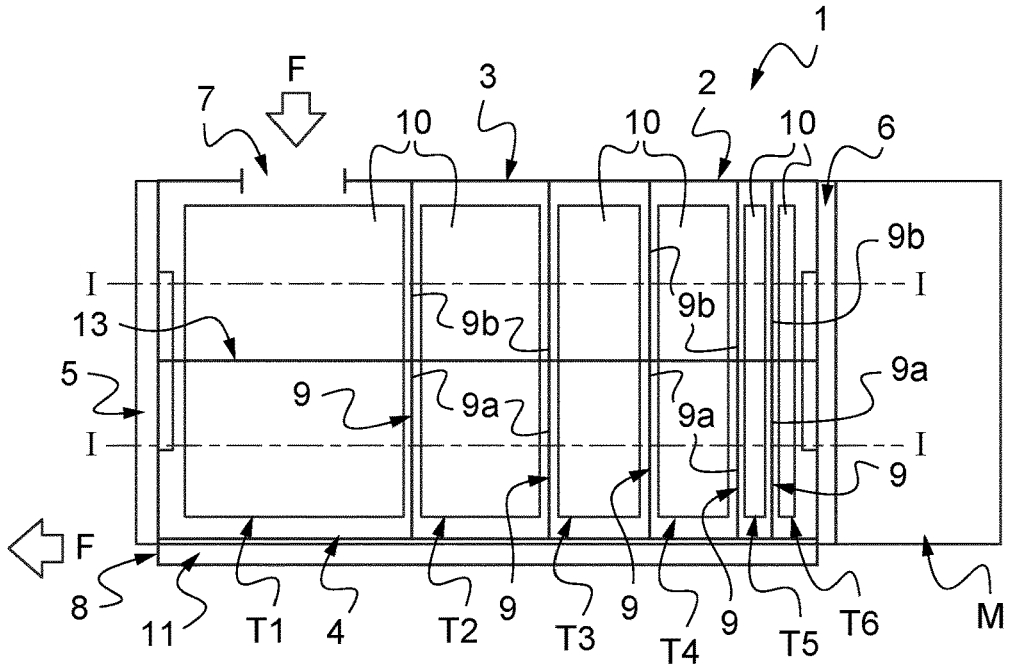
FIG. 1 is a very schematic representation of an example vacuum pump.

FIG. 1 shows a diagram of such a vacuum pump 1.

The vacuum pump 1 includes a stator 2 including at least a first half-shell 3 and a second half-shell 4 which are complementary and joined together. The stator 2 may also include a first end piece 5 and a second end piece 6 joined to the axial ends of the half-shells 3, 4.

The half-shells 3, 4 of the stator 2 form at least two pumping stages T1-T6 arranged in series between a suction port 7 and a delivery port 8 of the vacuum pump 1, such as between two and ten pumping stages (six in the illustrative example). The pumping stages T1-T6 are axially separated from each other by a respective inter-stage transverse wall 9 of the half-shells 3, 4.

The vacuum pump 1 also includes two shafts of the rotors 10 designed to rotate in the pumping stages T1-T6 such that the rotors 10 drive a gas being pumped between the suction port 7 and the delivery port 8 (FIG. 1).

Figure 10:
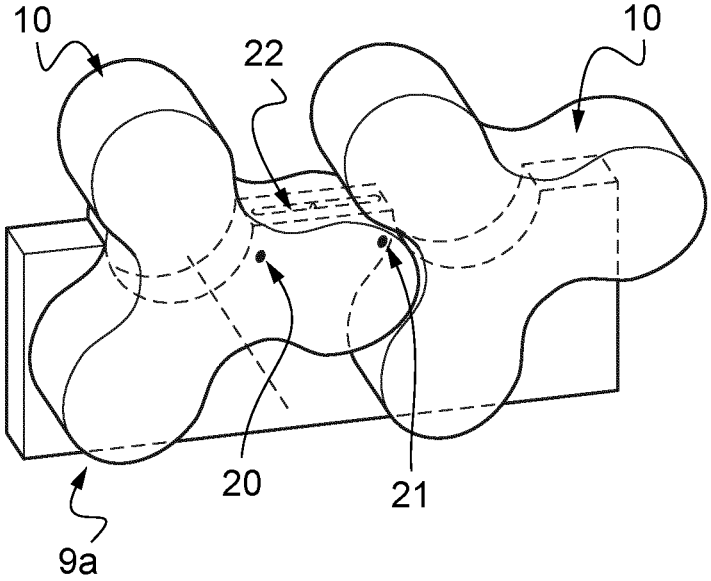
FIG. 10 shows a schematic view of the rotors in perspective arranged in front of the front face of the inter-stage transverse half-wall in which the orifices are provided.

The rotors have for example lobes with identical profiles, for example "Roots" rotors with two or more lobes (three in FIG. 10), or "claw" rotors, or rotors based on another similar principle for a positive-displacement vacuum pump. The shafts carrying the rotors are driven by a motor M located for example beside the delivery stage T6 at an axial end of the vacuum pump 1.

Each pumping stage accommodates two mating rotors 10, the pumping stages comprising a respective inlet and a respective outlet. When the shafts of the rotors 10 rotate in opposite directions about the respective axes of rotation thereof, the gas suctioned from the inlet is trapped in the volume created by the rotors 10 and the stator 2 and is then driven by the rotors 10 toward the next stage.

The successive pumping stages T1-T6 are connected in series one after another by respective transfer channels 12 connecting the outlet of the preceding pumping stage to the inlet of the following pumping stage. There are for example two transfer channels 12 for connecting an outlet of a pumping stage to the inlet of the next pumping stage, the transfer channels 12 being arranged on either side of the pumping stage. The openings of the transfer half-channels 12 are visible on the half-shell 4 in FIG. 2. This is the half-shell 4 in which the outlets of the pumping stages T1-T6 are provided, referred to here as the second half-shell.

The inlet of the first pumping stage T1 communicates with the suction port 7. The outlet of the last pumping stage T6 communicates with the delivery port 8. A duct 11 connecting the outlet of the last pumping stage T6 and the delivery port 8 of the vacuum pump 1 is for example formed in the body of the half-shell 4 under the pumping stages T1-T6.

The axial dimensions of the rotors and of the pumping chambers (and therefore the displacements) are for example the same or decrease with the pumping stages, the pumping stage T1 situated on the suction port 7 side accommodating the rotors of largest axial dimension and having the largest displacement.

These vacuum pumps are referred to as "dry" since, in operation, the rotors rotate inside the stator 2 without any mechanical contact with each other or with the stator 2, thereby obviating the need to use oil in the pumping stages.

The half-shells 3, 4 are joined together at a joining surface 13. The pumping stages T1-T6, the inter-stage transverse walls 9 and the transfer channels 12 are partly formed in the first half-shell 3 and partly in the second half-shell 4. In other words, more particularly, an inter-stage transverse wall 9 is formed by joining two inter-stage transverse half-walls 9*a*, 9*b* together.

The joining surface 13 passes for example through a longitudinal midplane of the dry vacuum pump 1 which contains for example the rotation axes I-I of the shafts of the rotors 10. Sealing grooves 14 can be provided in the half-shells 3, 4 at the joining surface 13 to accommodate sealing gaskets (not shown).

A first end of the half-shells 3, 4 is closed by the first end piece 5 and a second end of the half-shells 3, 4 is closed by the second end piece 6. Holes 15 are of course provided in the inter-stage transverse walls 9 of the half-shells 3, 4 separating the pumping stages T1-T6, and in the end pieces 5, 6 for the passage of the shafts of the rotors 10.

The vacuum pump 1 further includes at least one purge duct 16 designed to inject a purging gas such as nitrogen.

Figure 2:
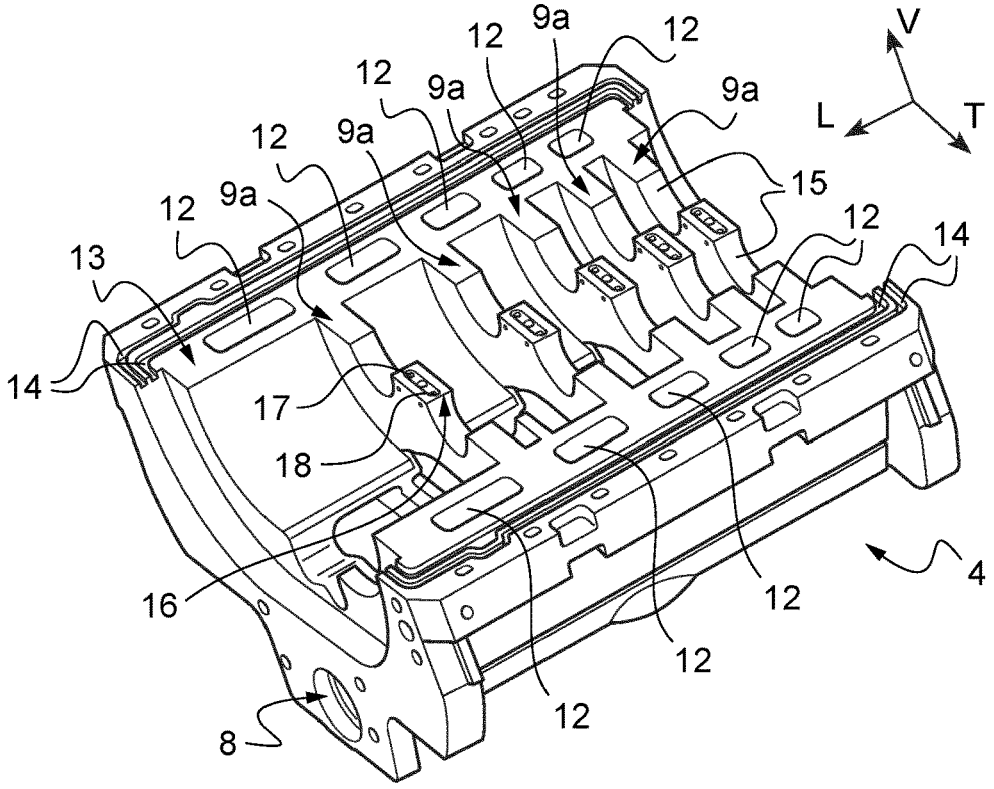
FIG. 2 shows a perspective view of a half-shell of the vacuum pump.

The purge duct 16 includes two channels 17, 18 provided in the thickness of an inter-stage transverse half-wall 9*a* of a half-shell 4 (FIG. 2).

Each channel 17, 18 discharges from a front face 19 of the inter-stage transverse half-wall 9*a* via a respective orifice 20, 21 into the space inside a pumping stage T1-T6 (FIGS. 3 and 4), partly delimited by the inter-stage transverse half-wall 9*a*.

The front face 19 of the inter-stage transverse half-wall 9*a* arranged between the pumping stages N and N+1 is that delimiting the pumping stage N. In other words, the channels are oriented so as to discharge toward the rear, in the direction opposite the direction of flow of the pumped gases.

These orifices 20, 21 are advantageously provided on a circle C defined by the sweep of the radial end of a respective rotor 10 (FIG. 4), the center of the circle C being the rotation axis I-I of the rotor 10. The orifices 20, 21 are for example provided at a distance d of between 5 mm and 15 mm from the joining surface 13 in the direction (V) perpendicular to the longitudinal (L) and transverse (T) directions. This distance d is related to the shape of the rotors 10 and is adapted so that the injection of the purging gas discharges at the delivery port of the meshing zone of the rotors 10.

Figure 5:
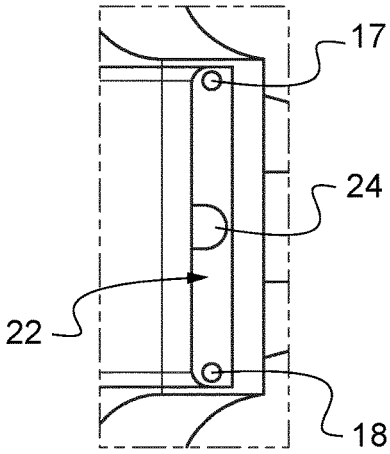
FIG. 5 shows an enlarged top view of a transverse groove of the inter-stage transverse half-wall.
Figure 6:
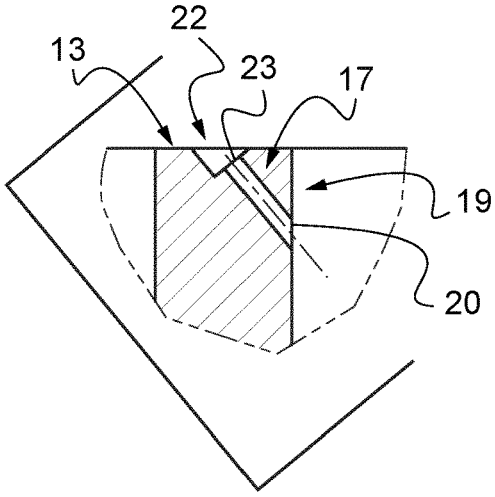
FIG. 6 shows an enlarged view along a longitudinal section plane of a channel and a transverse groove of the inter-stage transverse half-wall.

As shown more clearly in FIGS. 5 and 6, the purge duct 16 includes a transverse groove 22 provided in the inter-stage transverse half-wall 9*a* at the joining surface 13 of the half-shells 3, 4.

The surface of the inter-stage transverse half-wall 9*b* of the other half-shell 3 at the joining surface 13 may be flat.

Figure 7:
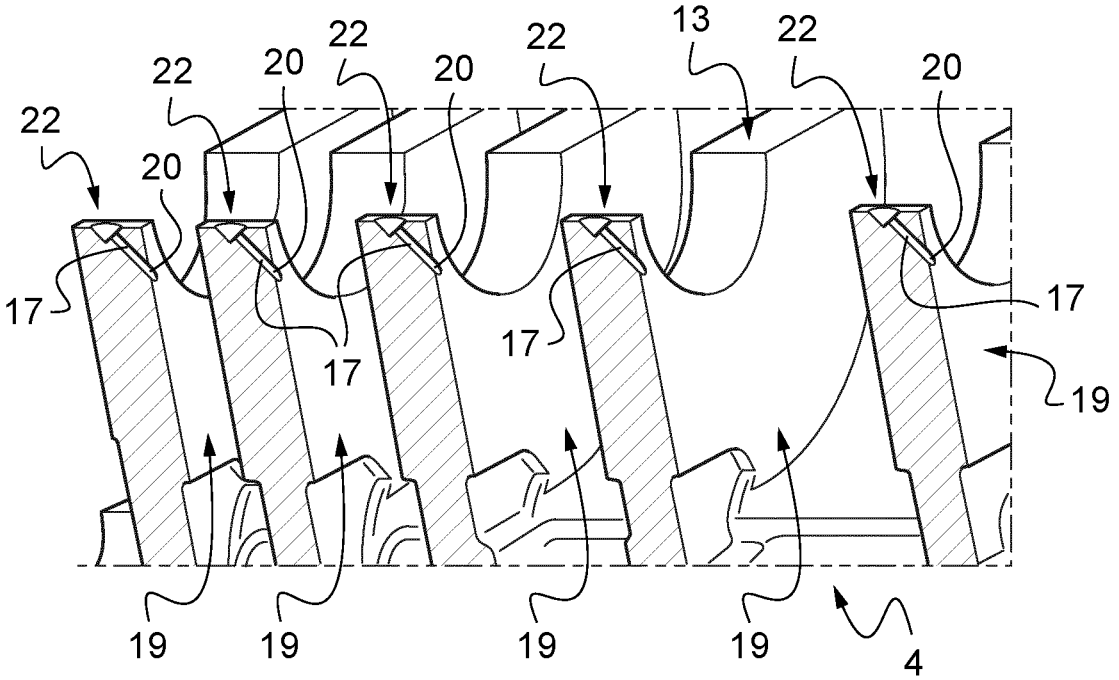
FIG. 7 shows a partial view in cross section of the half-shell in FIG. 2 along a longitudinal section plane passing through the channels of the purge ducts.

The channels 17, 18 are formed by (straight) tubular ducts formed between an inclined plane 23 of the transverse groove 22 and the front face 19 (FIGS. 6 and 7). The plane 23 is inclined, for example over the entire groove 22, with respect to the longitudinal plane (L, T) of the joining surface 13 separating the half-shells 3, 4, for example by an angle of between 30° and 60°, such as 45°.

The transverse groove 22 has for example a V-shaped longitudinal section, one branch of the "V" forming the inclined plane 23 on the side of the pumping stage into which the channels 17, 18 discharge (FIGS. 6 and 7). This V-shape is simple to machine.

The transverse groove 22 provided in the inter-stage transverse half-wall 9*a* provides access for a tool for forming the channels 17, 18 by drilling. The oblique drilling of the inter-stage transverse half-wall 9*a* is possible because the transverse groove 22 has an inclined plane 23, which allows the formation of orifices 20, 21 discharging into the front face 19, below the joining surface 13, despite the thinness of the inter-stage transverse walls 9.

The length of the channels 17, 18, between the inclined plane 23 and the front face 19, is for example between 6 mm and 14 mm, such as 10 mm. The diameter of the tubular channels 17, 18 is for example between 1 mm and 3 mm, such as 2 mm.

The channels 17, 18 discharge for example from the front face 19 of the inter-stage transverse half-wall 9*a* of the half-shell 4 bearing the outlets of the pumping stages T1-T6, here referred to as the second half-shell. The purging gas is thus injected on the side where the pressure of the gases, and therefore the risk of formation of deposits, is highest.

Figure 8:
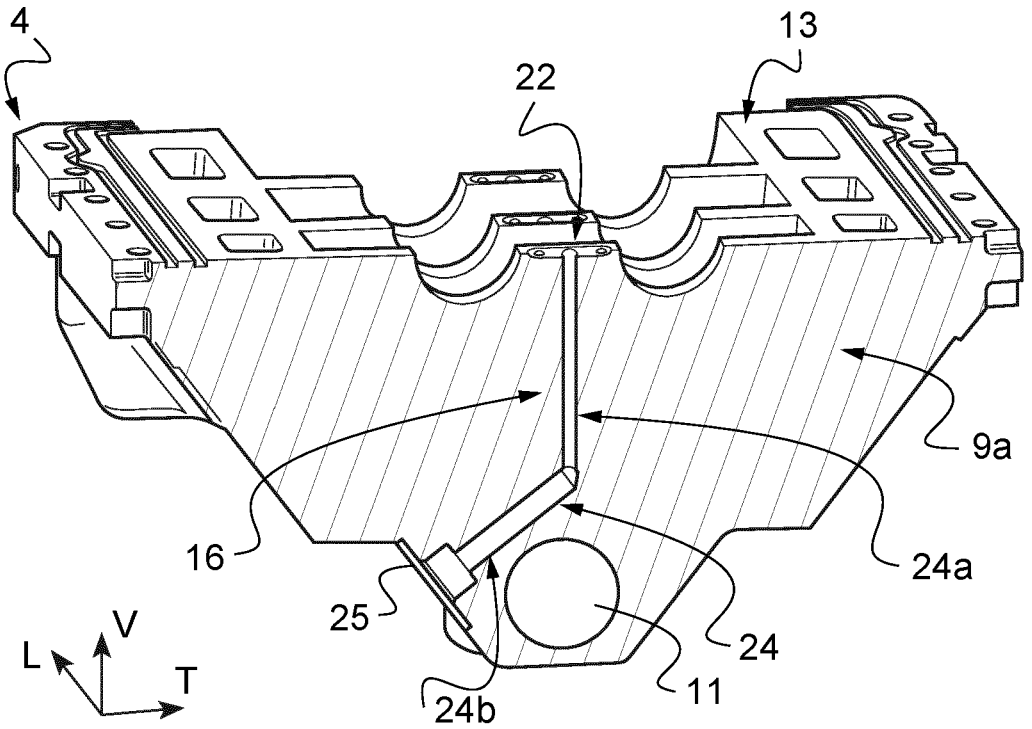
FIG. 8 shows a view in cross section of the half-shell in FIG. 2.

As shown more clearly in the cross section view in FIG. 8, the purge duct 16 includes for example a common duct 24 provided in the inter-stage transverse half-wall 9*a*, communicating with the transverse groove 22. The common duct 24 discharges for example at the center of the transverse groove 22.

In the illustrative example, the common duct 24 is formed by first and second straight ducts 24*a*, 24*b* in communication with each other. The first duct 24*a* extends perpendicularly to the joining surface 13, which makes it easy to form by machining from the joining surface 13. The second duct 24*b* extends perpendicularly to an outer surface, which is flat in this case, of the half-shell 4 so that it can also be easily formed by machining from the outer surface of the stator 2. This for example provides an elbowed common duct 24 extending between the transverse groove 22 provided at the joining surface 13 and an outer surface of the stator 2, for example located on one side of the vacuum pump 1.

There is for example a purge duct 16 provided in the thickness of the last inter-stage transverse half-wall 9*a* of the vacuum pump 1 in the direction of flow of the pumped gases F, the channels 17, 18 discharging into the space inside the last pumping stage T6. The last pumping stage T6 is the pumping stage where the gas pressure is highest.

Figure 3:
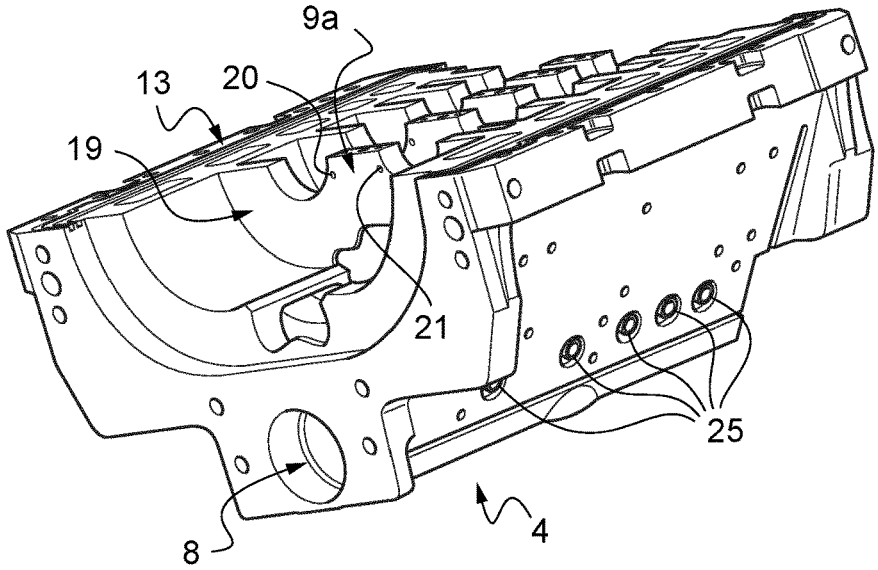
FIG. 3 shows another perspective view of the half-shell in FIG. 2.
Figure 4:
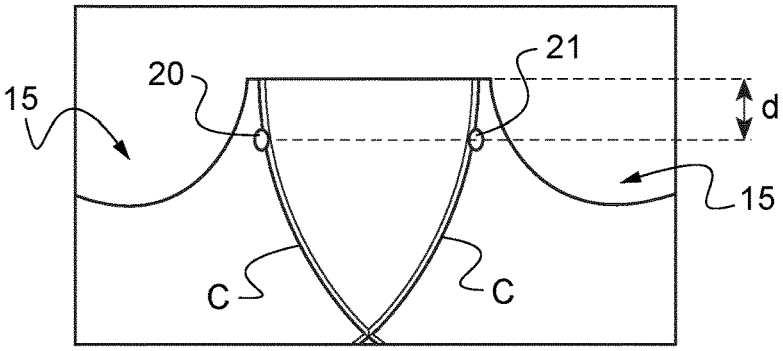
FIG. 4 shows an enlarged front view of a detail of an inter-stage transverse half-wall of the half-shell in FIG. 2.
Figure 9:
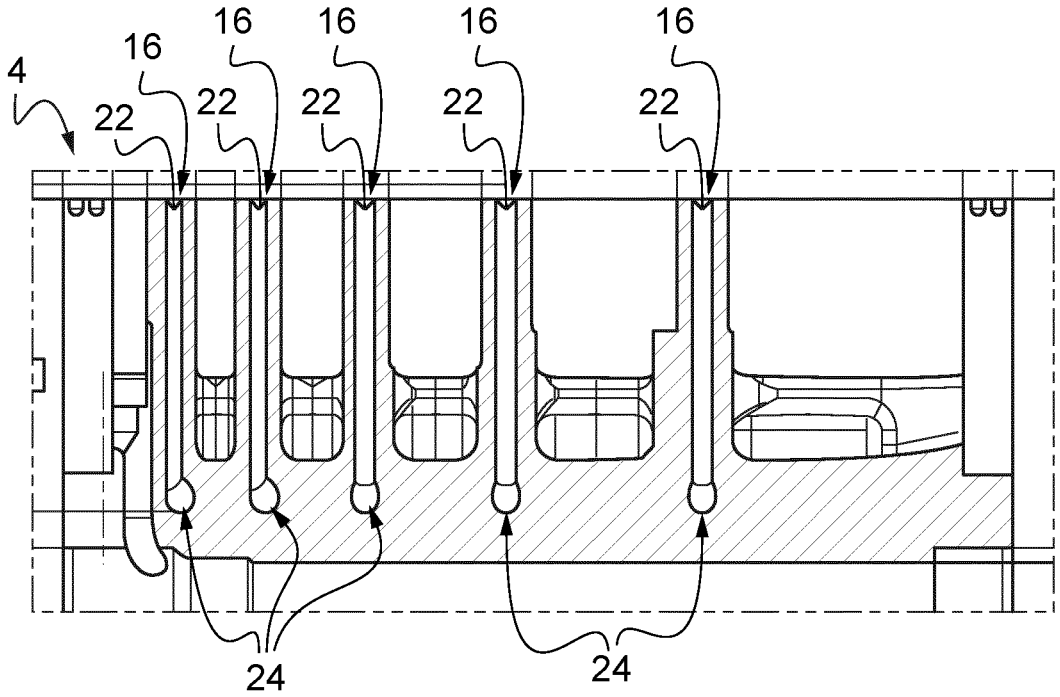
FIG. 9 shows a partial view in cross section of the half-shell in FIG. 2 along a longitudinal section plane passing through the common ducts of the purge ducts.

According to one example embodiment, the half-shells 3, 4 have several inter-stage transverse half-walls 9*a* (five in the illustrative example) and a purge duct 16 is provided in each inter-stage transverse half-wall 9*a*. All the common ducts 24 thus extend for example in a respective inter-stage transverse half-wall 9*a* in a vertical plane (FIG. 9), and discharge laterally from the stator 2 via a respective outlet orifice 25 (FIG. 3). These outlet orifices 25 are connected by an external distributor (not shown) to a source of purging gas.

In operation, the purging gas is distributed in the purge ducts 16 of each pumping stage T1-T6, first in the common ducts 24, then in the transverse grooves 22, then the channels 17 and 18 discharge from the front walls 9 into the space inside the pumping stages T1-T6.

The rotation of the rotors 10 in a pumping stage over a total angle of rotation of approximately 120° is shown schematically in successive FIGS. 11*a* to 11*d*, FIG. 10 showing these rotors 10 in perspective in front of the front face 19 of the inter-stage transverse half-wall 9*a* in which the orifices 20, 21 are provided.

Figure 11A:
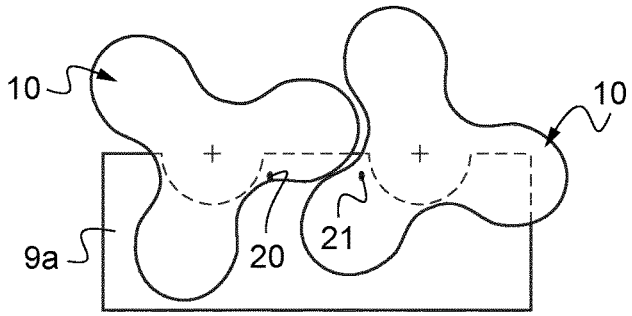
FIG. 11*a* shows the rotors in FIG. 10 in an initial angular position.
Figure 11B:
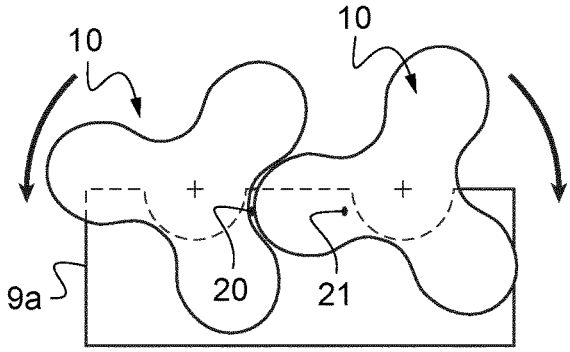
FIG. 11*b* shows the rotors in FIG. 10 in an angular position after the angular position in FIG. 11*a*.
Figure 11C:
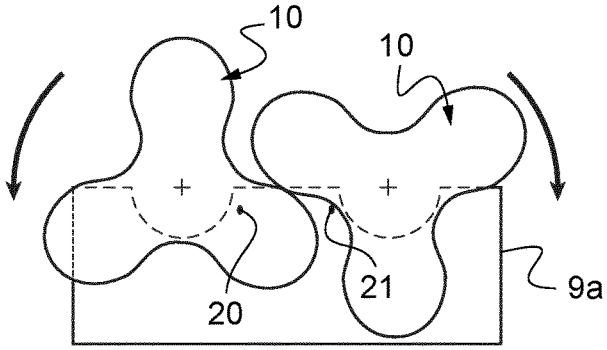
FIG. 11*c* shows the rotors in FIG. 10 in an angular position after the angular position in FIG. 11*b*.
Figure 11D:
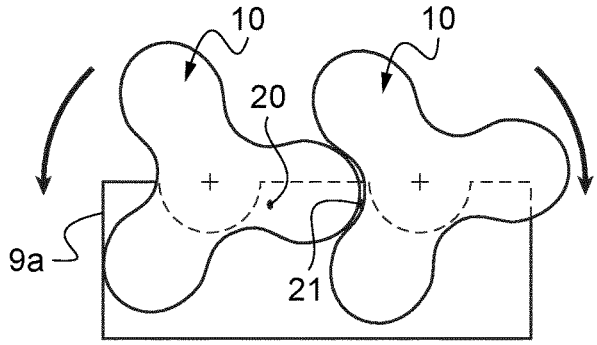
FIG. 11*d* shows the rotors in FIG. 10 in an angular position after the angular position in FIG. 11*c*.

Between FIG. 11*a* and FIG. 11*b*, it can be seen that the purging gas injected through the first orifice 20 flows over the periphery of a first rotor 10 while the second orifice 21 is closed by the second rotor 10. All the gas injected into the purge duct 16 is therefore mainly evacuated through the first open orifice 20, onto the edges of the first rotor 10. Then, as the rotation of the rotors 10 continues (FIG. 11*c* and then FIG. 11*d*), the first orifice 20 is closed by the first rotor 10 and the second orifice 21 allows the purging gas injected into the purge duct 16 to flow over the periphery of the second rotor 10. The rotors 10 then continue to rotate back to an angular position matching the initial angular position in FIG. 11*a*. Between the angular positions illustrated in FIGS. 11*a* to 11*d*, there are positions at which the rotors 10 simultaneously close both orifices 20, 21. The purging gas is then forced out behind the rotors 10, between the rotors 10 and the front faces 19, thereby cleaning the rotors 10.

The purge ducts 16 discharging into the pumping stages T1-T6 from the front face 19 facing the rotors 10 thus clean the profiles of the rotors 10 by means of an injection sequenced by the rotation of the rotors 10, notably in the critical zones between the rotors 10. The injection may in fact be localized at the meshing zone between the profiles of the rotors 10 where the volume is reduced.

The invention claimed is:

1. A dry vacuum pump comprising:

a stator including at least a first half-shell and a second half-shell which are complementary and joined together to form at least two pump stages, the at least two pump stages arranged in series and separated from each other in an axial direction by a respective inter-stage transverse wall of the half-shells;

two shafts of two rotors extending in the axial direction, configured to rotate in the at least two pump stages;

at least one purge duct including:

two channels provided in a thickness of an inter-stage transverse half-wall one of the first half-shell and the second half-shell, each channel of the two channels discharging from a front face of the inter-stage transverse half-wall via a respective orifice into a space inside a pumping stage of the at least two pump stages, and a transverse groove provided in the inter-stage transverse half-wall at a joining surface of the half-shells, the channels being formed by tubular ducts formed between an inclined plane of the transverse groove and the front face.

2. The vacuum pump as claimed in claim 1, wherein the transverse groove has a V-shaped longitudinal section.

3. The vacuum pump as claimed in claim 1, wherein a surface of an inter-stage transverse half-wall of the other half-shell of the one of the first half-shell and the second half-shell at the joining surface is flat.

4. The vacuum pump as claimed in claim 1, wherein the purge duct includes a common duct provided in the inter-stage transverse half-wall discharging at a center of the transverse groove.

5. The vacuum pump as claimed in claim 1, wherein the orifices are provided on a circle defined by a sweep of a radial end of a respective rotor of the rotors.

6. The vacuum pump as claimed in claim 1, wherein the orifices are provided at a distance of between 5 mm and 15 mm from the joining surface in a direction perpendicular to longitudinal and transverse directions.

7. The vacuum pump as claimed in claim 1, wherein a length of the channels is between 6 mm and 14 mm.

8. The vacuum pump as claimed in claim 7, wherein the length of the channels is 10 mm.

9. The vacuum pump as claimed in claim 1, wherein a diameter of the tubular ducts is between 1 mm and 3 mm.

10. The vacuum pump as claimed in claim 9, wherein the diameter of the tubular ducts is 2 mm.

11. The vacuum pump as claimed in claim 1, wherein the channels discharge from the front face of the inter-stage transverse half-wall of the one of the first half-shell and the second half-shell bearing the outlets of the pumping stages.

12. The vacuum pump as claimed in claim 1, wherein the half-shells have several inter-stage transverse half-walls, and a purge duct of the at least one purge duct is provided in each inter-stage transverse half-wall of the several inter-stage transverse half-walls.

13. The vacuum pump as claimed in claim 1, wherein the joining surface passes through rotation axes of the shafts of the rotors.

* * * * *